US005788284A

United States Patent [19]

Hirst

[11] Patent Number: 5,788,284

[45] Date of Patent: Aug. 4, 1998

[54] LABELS

[75] Inventor: Richard John Hirst, Fakenham, United Kingdom

[73] Assignee: Sinclair International Limited, Norfolk, United Kingdom

[21] Appl. No.: 526,048

[22] Filed: Sep. 8, 1995

[51] Int. Cl.[6] ..... B42D 15/00

[52] U.S. Cl. ..... 283/81; 283/100; 283/101; 428/42.3; 428/136

[58] Field of Search ..... 283/81, 100, 101; 428/40.1, 41.8, 42.1, 42.2, 42.3, 43, 136

[56] References Cited

U.S. PATENT DOCUMENTS

| | | | |
|---|---|---|---|
| 2,303,346 | 12/1942 | Flood | 156/152 |
| 2,331,019 | 10/1943 | Flood | 242/564.4 |
| 2,364,607 | 12/1944 | Dreher | 40/638 |
| 2,765,205 | 10/1956 | Capella et al. | 312/91 |
| 4,188,250 | 2/1980 | Grass | 428/43 X |
| 4,188,251 | 2/1980 | Grass et al. | 428/43 X |
| 4,188,427 | 2/1980 | Grass | 428/43 X |
| 4,217,164 | 8/1980 | La Mers | 156/541 |
| 4,454,180 | 6/1984 | La Mers | 283/81 X |
| 4,642,256 | 2/1987 | Sato | 428/906 X |
| 4,787,158 | 11/1988 | Vitol | 428/191 X |
| 5,112,427 | 5/1992 | Bekker-Madsen | 156/259 |
| 5,265,916 | 11/1993 | Coe | 283/83 X |

FOREIGN PATENT DOCUMENTS

| | | | |
|---|---|---|---|
| 0113256 | 7/1984 | European Pat. Off. | 283/81 |
| 1485774 | 9/1977 | United Kingdom | 283/81 |

*Primary Examiner*—Frances Han
*Attorney, Agent, or Firm*—Salter & Michaelson

[57] ABSTRACT

A label strip comprising a longitudinally divided strip of release paper and a plurality of labels disposed at intervals along the strip and spanning the division in the release paper. Imperfectly printed labels are also divided preferably in the same location as the release paper, so that upon separation of the parts of the release paper, the imperfectly printed labels are also separated and remain adhered to the release paper.

4 Claims, 2 Drawing Sheets

LABELS

This invention relates to self adhesive labels and more particularly self adhesive labels that are disposed on a strip of release paper.

Individual labelling of small items such as fruit and vegetables is now usually effected by means of self adhesive labels. These labels can be applied to the fruit or vegetable items by means of labelling machines of the kind described in our European Patent Application No. 0113256. The preferred form of these labelling machines includes a cassette for a reel of label strip, that is to say a reel of release paper with labels disposed on it at substantially regular intervals. The release paper of the label strip is longitudinally divided and the labels lie over this division. Separation of labels from the release paper is brought about by moving the label strip over a V shaped notch in a separator plate and moving the two parts of the release paper in mutually opposite directions and away from the direction of movement of the label strip whereby the label, which continues to move in the direction of the label strip, becomes detached from the release paper.

The preparation of label strip as described above comprises conversion of a web of self adhesive label material laminated to release paper. The web is printed on the label side with the required label design and the release paper is longitudinally slit with sufficient precision that only the release paper is cut and not the label material. A problem has arisen in connection with label strip prepared in this way. The label is printed with one or more colours with each colour being applied at a separate station. Every time the conversion process is stopped and then re-started, a regular occurrence, a section of about 50 mm in length (at each print station) will be unprinted or only partially printed. It is not practical to rewind the label strip, once converted, in order to remove the printing errors. As a result a reel of label strip can contain several lengths of incorrectly printed labels. Imperfectly printed labels are not acceptable since, instead of promoting a product, they may have an adverse effect, particularly on tray labelling systems where all the faulty labels can be seen together.

The present invention has been made in order to solve this problem.

According to the invention there is provided a label strip comprising a strip of release material longitudinally divided and a plurality of printed labels disposed along the release paper, each label spanning the longitudinal division of the release paper, characterised in that imperfectly printed labels are longitudinally slit.

By the present invention the divided labels are not separated from the release paper by a V notch separator in a labelling machine as described above, but instead divide with the release paper and stay attached to the release paper as it is led over the separator plate to a waste bin or the like. Conventional labelling machines are designed to synchronise with the spacing of labels along the label strip so that each item handled by the labelling machine will have one label applied to it. The slitting of imperfect labels in accordance with the invention, to prevent them being separated from the release paper, will have the result in some items being passed through the labelling machine without being labelled. However, an absence of labels on a small number of fruit items is acceptable and definitely preferred to labelling items with imperfectly printed labels.

The label strip of the invention can conveniently be made by modifying the conversion procedure of the web to form the label strip such that after the process is re-started after having stopped for whatever reason, a number of labels, preferably at least equal to the distance between printing stations, is longitudinally slit together with the release paper. The number of labels to be slit together with the release paper may be predetermined, preferably so as to ensure that all imperfect labels are cut. It can happen that some properly printed labels on one or both sides of the imperfectly printed label or labels are also cut so that those labels also will not be separated from the carrier strip and applied to items to be labelled either. However, as explained above it is usually acceptable for some items to be unlabelled.

While it is preferred that the imperfectly printed labels should be slit along the same longitudinally line of separation of the release paper, that is not essential. Slitting of the imperfect labels can be effected at any location provided that as a result a slit label is not separated from the release paper for application to an item to be labelled. In practice slitting along, or close to, the centreline will normally ensure that an imperfect label is not deposited on an item to be labelled.

A specific embodiment of the invention will now be described by way of example with reference to the accompanying drawings in which.

Figure 1:
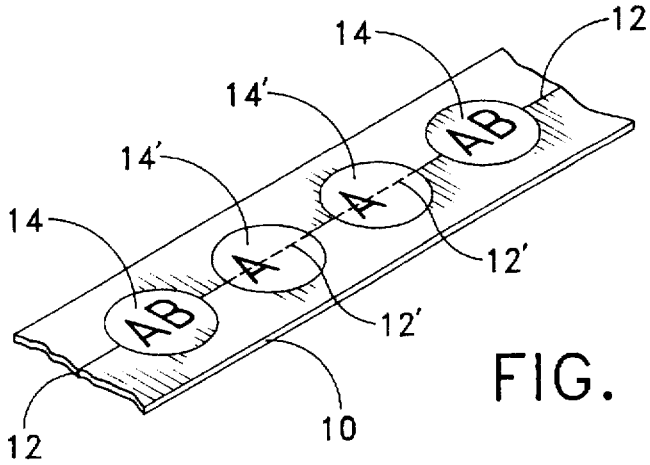
FIG. 1 is a perspective view from above of a part of a label strip.

Referring to the drawings the label strip comprises a web 10 of release material, usually paper. The release material is longitudinally split as at 12 along the centre line. Labels 14 are disposed along the web 10 at intervals. Each label spans the longitudinal slit 12 in the web.

In the illustrated embodiment two of the labels 14, referenced 14' are not properly printed. These labels, unlike the other correctly printed labels, are also slit into two halves as indicated at 12'. In the illustrated embodiment the slit 12' in the labels 14' coincides with the slit 12 in the web 10. Conveniently the slit 12' can be formed at the same time as slit 12 by arranging for a cutter to project through the web 10 and the label 14'. Imperfect printing normally occurs after the printing machine has been stopped. Slitting of labels can, therefore, be effected for a predetermined number of labels, say three or four every time the printing machine is re-started. It may be that on some occasions correctly printed labels 14 may also be slit, but this is preferred to applying an incorrectly printed label to an item to be labelled.

Figure 2:
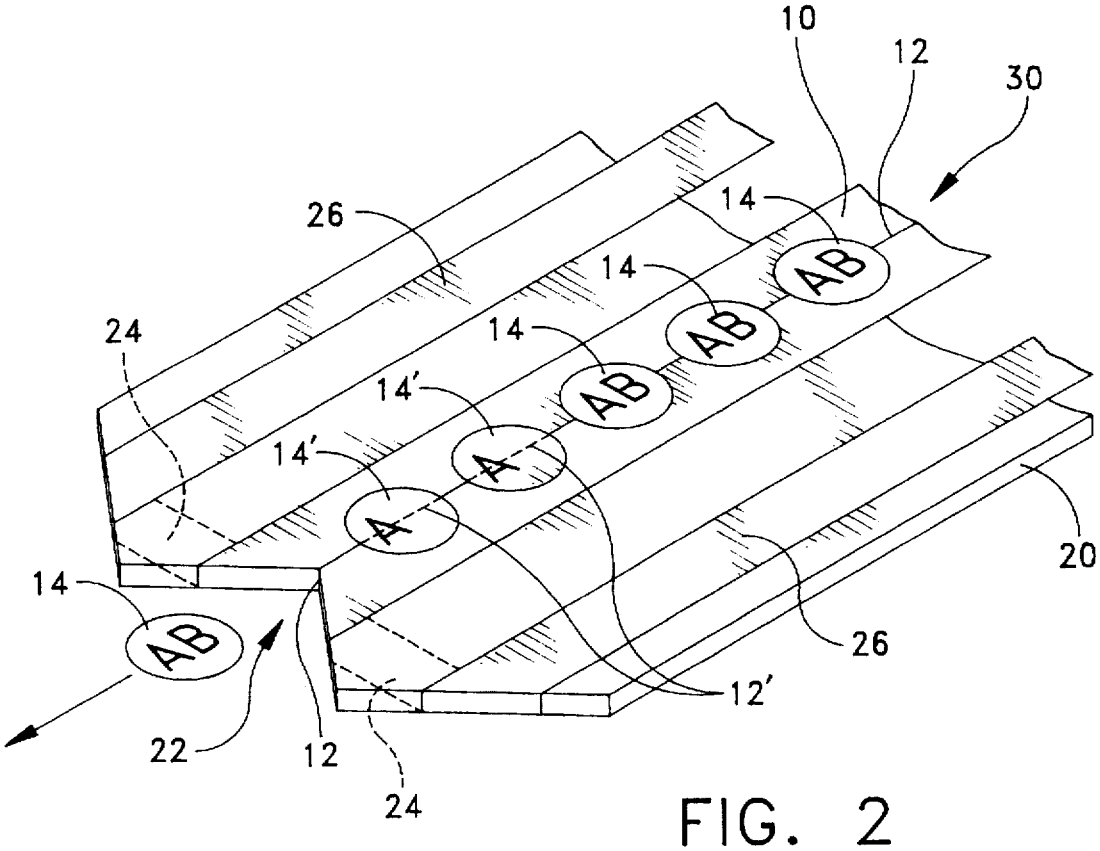
FIG. 2 shows the label strip of FIG. 1 passing over a stripper plate.

Referring now to FIG. 2, a known form of stripper plate 20 is illustrated. The stripper plate has a V shaped notch 22 at one edge. Label strip is led over the plate in the direction of the arrow 30 so that the slit 12 in the web is aligned with the apex of the V shaped notch. The web 12 is separated at the V shaped notch into two parts which are led away beneath the plate 20 in opposite directions as at 24 and then reversed over the top of the plate as at 26 where they are disposed of. The separation as described of the web 12 and the forwarding of the label strip has the effect of separating labels form the web and depositing them in the space defined by the V shaped notch from where they are picked up and transferred to an item to be labelled. This is well known and described in our above-mentioned European Patent Application No. 0113256.

Figure 3:
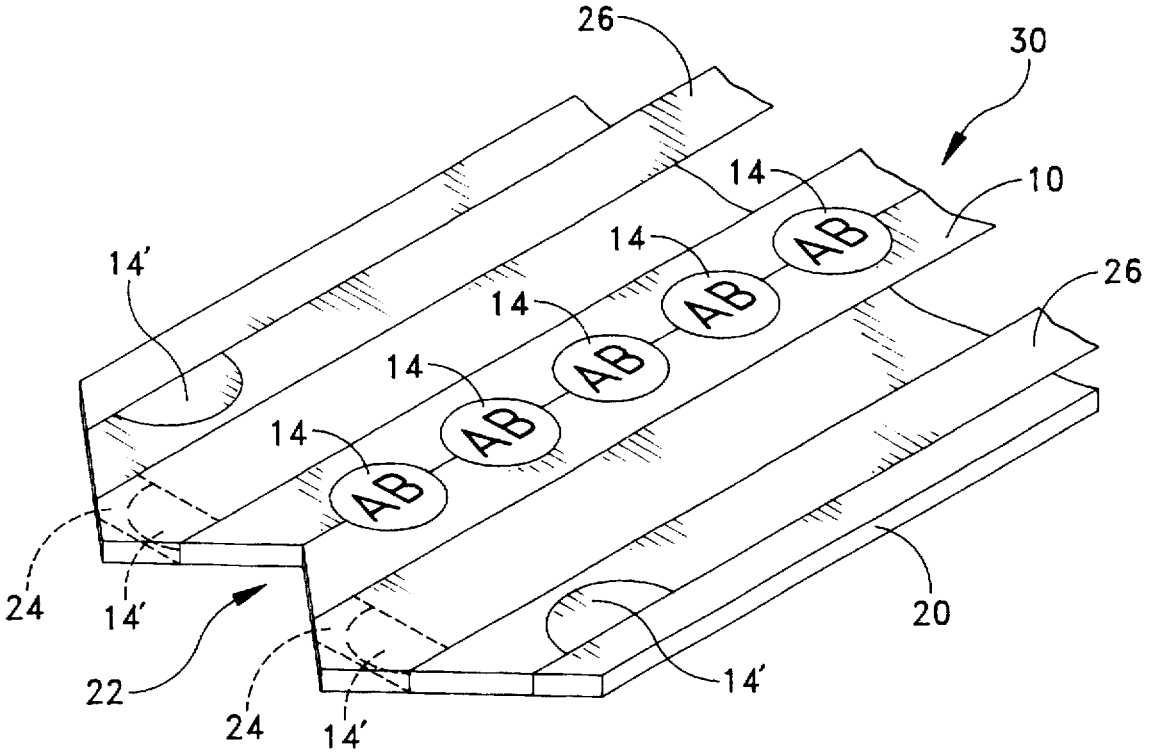
FIG. 3 shows the arrangement of FIG. 2, but at a later stage.

As shown in FIG. 3 when a slit label 14' reaches the V shaped notch instead of being separated from web 12, the label splits with the web and the parts continue to move with the separated parts of the web under the plate 20, as at 24 and back along the top of the plate as at 26. As a result the imperfect label is not delivered to an item to be labelled.

The invention is not restricted to the above-described embodiment and many variations and modifications can be made.

I claim:

1. A label strip comprising:

a strip of release material having a longitudinal division; and a plurality of printed labels disposed along the strip of release material, each of said labels spanning the longitudinal division of the release material, said plurality of printed labels including imperfectly printed labels, each of said imperfectly printed labels having been selectively provided with a longitudinal slit therein.

2. The label strip as claimed in claim 1 wherein the longitudinal slit in the imperfectly printed labels is substantially in alignment with the longitudinal division of the strip of release material.

3. The label strip as claimed in claim 1 wherein the longitudinal slit in the imperfectly printed labels is substantially in alignment with a longitudinal center line of the imperfectly printed labels.

4. A label strip comprising:

a strip of release material having a longitudinal division dividing the strip into opposing halves; and a plurality of printed labels disposed along the strip of release material, each of said labels spanning the longitudinal division of the release material, said plurality of printed labels including imperfectly printed labels, each of said imperfectly printed labels having been selectively provided with a longitudinal slit therein whereby upon separation of the opposing halves of the strip of release material, the imperfectly printed labels are separated along their respective longitudinal slit and remain adhered to the respective halves of the strip of release material.

* * * * *